US009957595B2

(12) United States Patent
Cha et al.

(10) Patent No.: US 9,957,595 B2
(45) Date of Patent: May 1, 2018

(54) CARBURIZED ALLOY STEEL HAVING IMPROVED DURABILITY AND METHOD OF MANUFACTURING THE SAME

(71) Applicant: Hyundai Motor Company, Seoul (KR)

(72) Inventors: Sung-Chul Cha, Seoul (KR); Moon-Ki Bae, Anyang-si (KR); Seung-Hyun Hong, Seoul (KR); Si-Yup Lee, Uiwang-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 190 days.

(21) Appl. No.: 14/920,766

(22) Filed: Oct. 22, 2015

(65) Prior Publication Data

US 2016/0304997 A1 Oct. 20, 2016

(30) Foreign Application Priority Data

Apr. 14, 2015 (KR) ..... 10-2015-0052243

(51) Int. Cl.

| | |
|---|---|
| ***C22C 38/54*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/04*** | (2006.01) |
| ***C22C 38/02*** | (2006.01) |
| ***C22C 38/00*** | (2006.01) |
| ***C21D 1/58*** | (2006.01) |
| ***C23C 8/22*** | (2006.01) |
| ***C23C 8/80*** | (2006.01) |

(52) U.S. Cl.

CPC ..... *C22C 38/54* (2013.01); *C21D 1/58* (2013.01); *C22C 38/001* (2013.01); *C22C 38/002* (2013.01); *C22C 38/02* (2013.01); *C22C 38/04* (2013.01); *C22C 38/44* (2013.01); *C22C 38/46* (2013.01); *C22C 38/48* (2013.01); *C22C 38/50* (2013.01); *C23C 8/22* (2013.01); *C23C 8/80* (2013.01)

(58) Field of Classification Search

CPC ..... C21D 1/58; C22C 38/001; C22C 38/02; C22C 38/04; C22C 38/44; C22C 38/46; C22C 38/48; C22C 38/50; C22C 38/54; C23C 8/22; C23C 8/80

See application file for complete search history.

(56) References Cited

U.S. PATENT DOCUMENTS

| | | | | |
|---|---|---|---|---|
| 8,475,605 | B2 | 7/2013 | Kubota | |
| 2005/0045248 | A1* | 3/2005 | Otani | C21D 1/78 148/219 |
| 2005/0051240 | A1* | 3/2005 | Takayama | C23C 8/22 148/224 |
| 2012/0018050 | A1* | 1/2012 | Kubota | C21D 9/32 148/219 |
| 2012/0168035 | A1* | 7/2012 | Tsuchida | C21D 1/06 148/318 |
| 2016/0305006 | A1* | 10/2016 | Cha | C23C 8/22 |

FOREIGN PATENT DOCUMENTS

| | | | |
|---|---|---|---|
| JP | 09-053148 | A | 2/1997 |
| JP | 2001-303173 | A | 10/2001 |
| JP | 2011-184768 | A | 9/2011 |
| KR | 1998-0086279 | A | 12/1998 |
| KR | 2010-0125367 | A | 11/2010 |
| KR | 10-2011-0128282 | A | 11/2011 |

* cited by examiner

*Primary Examiner* — Veronica F Faison

(74) *Attorney, Agent, or Firm* — McDermott Will & Emery LLP

(57) ABSTRACT

A carburized alloy steel includes, based on a total weight of the carburized alloy steel, 0.1 to 0.35 wt % carbon, 0.1 to 2.0 wt % silicon, 0.1 to 1.5 wt % manganese, 1.5 to 3.0 wt % chromium, 0.2 to 0.5 wt % molybdenum, greater than 0 to 0.07 wt % niobium, and a balance of iron.

3 Claims, No Drawings

CARBURIZED ALLOY STEEL HAVING IMPROVED DURABILITY AND METHOD OF MANUFACTURING THE SAME

CROSS-REFERENCE TO RELATED APPLICATIONS

This application claims the benefit under 35 U.S.C. § 119 of priority to Korean Patent Application No. 10-2015-52243, filed on Apr. 14, 2015, in the Korean Intellectual Property Office, the entirety of which is incorporated herein by reference.

TECHNICAL FIELD

The present disclosure relates to a carburized alloy steel having improved durability and a method of manufacturing the same, and more particularly, to a carburized alloy steel having an appropriate constitutional component and content so as to effectively cause carburizing on a surface of the alloy steel and thus improve hardness, strength, toughness, fatigue strength, fatigue life, and the like, and a method of manufacturing the same.

BACKGROUND

In recent years, environmental problems have been on the rise around the globe, and thus methods for reducing fuel consumption in order to cope with such problems in entire industries have been sought. To reduce fuel consumption, solutions proposed in the vehicle industry include improving efficiency of vehicle engines and weight reduction of vehicles. Reducing the weight of the vehicle may be a measure capable of increasing fuel efficiency of the vehicle. However, if the weight of the vehicle is reduced, there may occur a problem in that the strength and durability required in vehicles may not be satisfied. Therefore, a solution thereof becomes a major goal of the vehicle industry.

Therefore, in the vehicle industry, various environmentally-friendly vehicles have been developed with an object of reducing a discharge amount of carbon dioxide to 95 g/km, which is 27% of the current amount thereof, by 2021 based on European regulations. Furthermore, vehicle makers strive to develop technology to downsize and improve fuel economy in order to meet 54.5 mpg (23.2 km/1) which is the required value of the corporate average fuel economy (CAFE) in the USA by 2025.

Generally, in order to cope with an increase in the number of parts or an increase in weight, the weight of a material is reduced. In this case, as a weight reduction method, a heat treatment technology for implementing high strength of the material or curing a material surface is frequently used. Furthermore, to cope with complicated part shapes, precise joining, low-distortion welding, and low-distortion heat-treatment technologies are used. In addition, technology for reducing distortion caused by heat treatment, and noise reduction and dust-removing technologies are used.

For example, a high-performance and high-efficiency technology for engines and transmissions for maximizing fuel economy of vehicles has been developed, and this technology includes increased number of gears, a novel concept driveaway device, high-efficiency two-pump systems, fusion hybrid technology, technologies related to an automatic/manual fusion transmission, a hybrid transmission, and the like.

An alloy steel used in technology relating to engines and transmissions may be used in parts of the engine, carriers of the transmission, gears, shafts, synchronizer hubs, or the like, and a use ratio of the alloy steel corresponds to 32 to 40% based on the weight of the engine and about 58 to 62 wt % based on the weight of the transmission. For example, in the gears of the transmission and the like, development of highly strengthened and highly durable materials meeting the requirements of weight reduction and downsizing have been continuously required. However, a technology relating to downsizing or improvement of fuel efficiency has problems in that a load applied to the parts of the engines is increased, quality of the parts is reduced, and durability life is reduced due to burning, friction, abrasion, and the like.

Generally, the gears of the transmission of the vehicle are parts that directly transfer engine power to a differential system and effectively transfer rotation or power between two or more shafts so that engine power is attuned to a driving state of the vehicle, and bending stress and contact stress are simultaneously received. In the gears, when durability of the material is insufficient, fatigue failure (tooth breakage) due to a lack of bending fatigue strength and fatigue damage (pitting) due to a lack of contact fatigue strength frequently occur. Therefore, in the gears, physical properties such as hardness, strength, toughness, fatigue strength, and fatigue life are required.

As an alternative to the aforementioned requirements, currently, a carburized steel such as SCM820PRH including 0.17 to 0.23 wt % of carbon (C), 0.5 to 0.7 wt % of silicon (Si), 0.45 to 0.75 wt % of manganese (Mn), 1.95 to 2.25 wt % of chromium (Cr), 0.015 to 0.035 wt % of molybdenum (Mo), 0.0015 wt % of oxygen ($O_2$), and the like is used. However, this carburized steel has a problem in that tooth breakage and pitting easily occur.

SUMMARY

The present disclosure provides a carburized alloy steel having improved physical properties such as hardness, strength, toughness, fatigue strength, and a fatigue life, and a method of manufacturing the same.

The present disclosure has been made in an effort to provide a carburized alloy steel including carbon (C), silicon (Si), manganese (Mn), chromium (Cr), molybdenum (Mo), niobium (Nb), boron (B), vanadium (V), nickel (Ni), titanium (Ti), and nitrogen (N) to improve physical properties such as hardness, strength, and toughness and thus have improved durability, and a method of manufacturing the same.

An exemplary embodiment of the present inventive concept provides a carburized alloy steel comprising, based on a total weight of the carburized alloy steel, 0.1 to 0.35 wt % carbon, 0.1 to 2.0 wt % silicon, 0.1 to 1.5 wt % manganese, 1.5 to 3.0 wt % chromium, 0.2 to 0.5 wt % molybdenum, greater than 0 to 0.07 wt % niobium, and a balance of iron.

The carburized alloy steel may further comprise nickel. The content of nickel may be 0.1 to 0.6 wt %.

The carburized alloy steel may further comprise vanadium. The content of vanadium may be more than 0 to 0.3 wt %.

The carburized alloy steel may further comprise titanium. The content of titanium may be more than 0 to 0.2 wt %.

The carburized alloy steel may further comprise nitrogen. The content of nitrogen may be more than 0 to 0.015 wt %.

The carburized alloy steel may further comprise boron. The content of boron may be 0.00002 to 0.00005 wt %.

In another embodiment, the carburized alloy steel may further comprise at least one selected from the group consisting of nickel, vanadium, titanium, nitrogen, and boron.

A content of nickel may be 0.1 to 0.6 wt %, a content of vanadium may be more than 0 to 0.3 wt %, a content of titanium may be more than 0 to 0.2 wt %, a content of nitrogen may be more than 0 to 0.015 wt %, and a content of boron may be 0.00002 to 0.00005 wt %, based on a total weight of the carburized alloy steel.

In another embodiment, a method of manufacturing a carburized alloy steel is provided. The method comprises steps of carburizing an alloy steel comprising, based on a total weight of the carburized alloy steel, 0.1 to 0.35 wt % carbon, 0.1 to 2.0 wt % silicon, 0.1 to 1.5 wt % manganese, 1.5 to 3.0 wt % chromium, 0.2 to 0.5 wt % molybdenum, greater than 0 to 0.07 wt % niobium, and a balance of iron, at 880 to 940° C. for 1.5 to 2 hours; oil-quenching the carburized alloy steel at 80 to 120° C.; and tempering the oil-quenched alloy steel at 170 to 200° C. for 1 to 3 hours.

A transmission for a vehicle may be manufactured using the carburized alloy steel.

According to the carburized alloy steel and the method of manufacturing the carburized alloy steel of the present inventive concept, carbon (C), silicon (Si), manganese (Mn), chromium (Cr), molybdenum (Mo), niobium (Nb), vanadium (V), nickel (Ni), titanium (Ti), nitrogen (N), and boron (B) are included to improve durability such as hardness, strength, toughness, fatigue strength, and a fatigue life of a material.

It is also possible to make high strength of the carburized alloy steel feasible, and thus, through a thickness reduction, a weight reduction of about 20%, and the like, to secure the degree of freedom of a vehicle design and reduce manufacturing cost.

According to a transmission for a vehicle manufactured by using the carburized alloy steel that is the present inventive concept, it is possible to increase durability of the vehicle and achieve a feasible weight reduction of the vehicle, and thus increase fuel efficiency and prevent environmental pollution.

DETAILED DESCRIPTION OF THE EMBODIMENTS

Hereinafter, exemplary embodiments of the present inventive concept will be described in detail. Terms or words used in the present specification and claims should not be interpreted as being limited to typical or dictionary meanings, but should be interpreted as having meanings and concepts which comply with the technical spirit of the present inventive concept, based on the principle that an inventor can appropriately define the concept of the term to describe his/her own inventive concept in the best manner. Accordingly, the constitution of the embodiment described in the present specification is just one embodiment of the present inventive concept but does not indicate all technical spirits of the present inventive concept. Therefore, it should be understood that there are various equivalents and modifications replacing the embodiments at the time of filing of the present application.

Hereinafter, the present inventive concept will be described in detail. The present inventive concept relates to a carburized alloy steel having improved durability and a method of manufacturing the same. In one aspect, the present inventive concept relates to a carburized alloy steel having improved durability.

The carburized alloy steel having improved durability according to the present inventive concept may be formed to include, based on a total weight of the alloy steel, iron (Fe) as a main component, 0.1 to 0.35 wt % of carbon (C), 0.1 to 2 wt % of silicon (Si), 0.1 to 1.5 wt % of manganese (Mn), 1.5 to 3.0 wt % of chromium (Cr), 0.2 to 0.5 wt % of molybdenum (Mo), 0.1 to 0.6 wt % of nickel (Ni), more than 0 wt % and 0.07 wt % or less of niobium (Nb), more than 0 wt % and 0.3 wt % or less of vanadium (V), more than 0 wt % and 0.2 wt % or less of titanium (Ti), more than 0 wt % and 0.015 wt % or less of nitrogen (N), and 0.00002 to 0.00005 wt % of boron (B).

In more detail, numerical values for components constituting the carburized alloy steel according to the present inventive concept are as follows.

(1) 0.1 to 0.35 wt % of Carbon (C)

Carbon (C) is an interstitial matrix strengthening element, and is combined with an element such as chromium (Cr) to form a carbide and thus improve strength, hardness, and the like, and to increase surface hardness and to generate a precipitate carbide during carburizing.

The content of carbon (C) may be about 0.1 to 0.35 wt % based on the total weight of the alloy steel. Herein, when the content of carbon (C) is less than about 0.1 wt %, strength of the alloy steel may be reduced, and it may be difficult to secure hardness by carburizing. On the other hand, when the content of carbon (C) is more than about 0.35 wt %, core hardness of the alloy steel is increased due to excessive carburizing to reduce total toughness of the alloy steel.

(2) 0.1 to 2 wt % of Silicon (Si)

Silicon (Si) hinders carburizing when added in an excessive amount, but suppresses formation of pin holes in the alloy steel as a deoxidizer, increases strength of the alloy steel by a solid-solution strengthening effect by being solid-solved in a matrix, and increases activity of carbon (C) and the like.

The content of silicon (Si) may be about 0.1 to 2.0 wt % based on the total weight of the alloy steel. Herein, when the content of silicon (Si) is less than about 0.1 wt %, there is little effect as a deoxidizer, and on the other hand, when the content of silicon (Si) is more than about 2.0 wt %, the solid-solution strengthening effect of the matrix is excessively increased to reduce formability, carburizing property, and the like.

(3) 0.1 to 1.5 wt % of Manganese (Mn)

Manganese (Mn) improves a quenching property of the alloy steel and improves strength of the alloy steel and the like. The content of manganese (Mn) may be about 0.1 to 1.5 wt %. Herein, when the content of manganese (Mn) is less than about 0.1 wt %, a sufficient quenching property and the like may not be secured, and on the other hand, when the content of manganese (Mn) is more than about 1.5 wt %, grain boundary oxidation occurs, and mechanical properties of the alloy steel are reduced.

(4) 1.5 to 3.0 wt % of Chromium (Cr)

Chromium (Cr) improves a quenching property of the alloy steel, simultaneously providing hardenability and micronizing a tissue of the alloy steel, and promoting carburizing and reducing a carburizing time by reacting with carbon (C) to form a fine carbide. Further, formation of the precipitate carbide and cementite is increased.

The content of chromium (Cr) may be about 1.5 to 3.0 wt %. Herein, when the content of chromium (Cr) is less than about 1.5 wt %, an effect of carbide formation is reduced, and on the other hand, when the content of chromium (Cr) is more than about 3.0 wt %, toughness of the alloy steel is reduced, and grain boundary oxidation occurs. An effect according to an increase in content is insignificant to cause an increase in manufacturing cost.

(5) 0.2 to 0.5 wt % of Molybdenum (Mo)

Molybdenum (Mo) increases formation of the carbide, increases stability at high temperatures, and reduces activity of carbon. Further, molybdenum (Mo), after quenching or tempering, improves hardenability, toughness, and the like of the alloy steel and provides brittleness resistance.

The content of molybdenum (Mo) may be about 0.2 to 0.5 wt %. Herein, in the case where the content of molybdenum (Mo) is less than about 0.2 wt %, hardenability and toughness of the alloy steel and the like may not be sufficiently secured, and on the other hand, when the content of molybdenum (Mo) is more than about 0.5 wt %, processability (machinability) and productivity of the alloy steel and the like are reduced.

(6) More than 0 wt % and 0.07 wt % or Less of Niobium (Nb)

Niobium (Nb) combines with nitrogen to form a nitride and the like to micronize crystal grains, increase recrystallization temperature, and facilitate high-temperature carburizing, and thus improve hardenability and toughness of the alloy steel and the like. The content of niobium (Nb) may be more than 0 wt % and about 0.07 wt % or less.

Herein, when the content of niobium (Nb) is more than about 0.07 wt %, an effect of niobium (Nb) is saturated, toughness is reduced, and processability, productivity, and the like are reduced. On the other hand, when niobium (Nb) is not included, it may be difficult to perform a carburizing process at high temperatures.

(7) More than 0 wt % and 0.3 wt % or Less of Vanadium (V)

Vanadium (V) forms precipitates such as carbides, strengthens a matrix tissue through a precipitation strengthening effect, improves strength and wear resistance, and micronizes crystal grains. Further, vanadium (V) reduces the activity of carbon.

The content of vanadium (V) may be more than 0 wt % and about 0.3 wt % or less. Herein, when the content of vanadium (V) is more than about 0.3 wt %, toughness and hardness of the alloy steel and the like may be reduced.

(8) More than 0 wt % and 0.2 wt % or Less of Titanium (Ti)

Titanium (Ti) forms a carbonitride to suppress growth of the crystal grains and improve high temperature stability, strength, toughness, and the like. The content of titanium (Ti) may be more than 0 wt % and about 0.2 wt % or less.

Herein, when the content of titanium (Ti) is more than about 0.2 wt %, a coarse precipitate is formed, and due to a reduction in low temperature impact property and saturation of the effect thereof, a manufacturing cost is increased.

(9) More than 0 wt % and 0.015 wt % or Less of Nitrogen (N)

Nitrogen (N) stabilizes austenite, micronizes crystal grains thereof, and improves tensile strength, yield strength, and elongation of the alloy steel and the like. However, a durability life may be reduced due to formation of impurities.

The content of nitrogen (N) may be more than 0 wt % and about 0.015 wt % or less. Herein, when the content of nitrogen (N) is about 0.015 wt % or less, brittleness may be caused and a durability life and the like may be reduced.

(10) 0.00002 to 0.00005 wt % of Boron (B)

Boron (B) improves hardenability, tensile strength, impact resistance, and strength of the alloy steel, and prevents corrosion. However, weldability may be reduced.

The content of boron (B) may be about 0.00002 to 0.00005 wt %. Herein, when the content of boron (B) is less than about 0.00002 wt %, it is difficult to secure sufficient hardenability of the alloy steel, and on the other hand, when the content of boron (B) is more than about 0.00005 wt %, toughness and ductility of the alloy steel and the like are reduced to reduce impact resistance and the like.

(11) 0.1 to 0.6 wt % of Nickel (Ni)

Nickel (Ni) improves heat resistance and toughness. The content of nickel (Ni) may be about 0.1 to 0.6 wt %. Herein, when the content of nickel (Ni) is less than about 0.1 wt %, sufficient heat resistance and toughness may not be secured, and on the other hand, when the content of nickel (Ni) is more than about 0.6 wt %, processability (machinability) and productivity of the alloy steel and the like are reduced.

Since the carburized alloy steel having the aforementioned constitution according to the present inventive concept has superior hardness, strength, toughness, fatigue strength, and fatigue life, the carburized alloy steel may be applied to vehicle parts and the like. For example, the carburized alloy steel may be applied to automatic or manual transmissions and the like. Among the transmissions, the carburized alloy steel may be applied to carriers, annulus gears, gears, shafts, synchronizer hubs, or the like.

Hereinafter, in another aspect, the present inventive concept relates to a method of manufacturing a carburized alloy steel having improved durability.

The carburized alloy steel having improved durability according to the present inventive concept may be appropriately manufactured by a person with skill in the art with reference to a publicly known technology. To be more specific, the method of manufacturing the carburized alloy steel having improved durability according to the present inventive concept may include mixing materials of the alloy steel for carburizing; carburizing heat-treating the alloy steel at about 930 to 980° C. for about 1.6 to 4 hours; oil-quenching the carburized heat-treated alloy steel at about 80 to 120° C.; and tempering the oil-quenched alloy steel at about 150 to 200° C. for about 1 to 3 hours.

In the step of mixing the materials of the alloy steel for carburizing, iron (Fe) is configured as a main component, and nickel (Ni), vanadium (V), titanium (Ti), nitrogen (N), or boron (B) may be selectively added to carbon (C), silicon (Si), manganese (Mn), chromium (Cr), molybdenum (Mo), and niobium (Nb) to perform mixing.

Herein, for the carburizing heat-treating step, when the heat-treating temperature is less than about 930° C., since a heat-treating time is increased, productivity is reduced, and in the case where the heat-treating time is less than about 1.6 hours, since times of supplying, injecting, and diffusing carbon (C) are short, carburizing may not be sufficiently performed.

On the other hand, in the case where the heat-treating temperature is more than about 980° C., recrystallization of the alloy steel may occur to reduce mechanical properties, and in the case where the heat-treating time is more than about 4 hours, over-carburizing and thermal deformation may occur, and the manufacturing cost may increase.

In the oil-quenching step, if the oil-quenching temperature is less than about 80° C., or in the case where in the fourth step, a tempering temperature is less than about 150° C., since residual austenite is not formed, it may be difficult to secure the toughness of the alloy steel, and when the tempering time is less than about 1 hour, relaxation of brittleness may be insufficient, material deviation may be severe, and it may be difficult to secure toughness.

On the other hand, when the oil-quenching temperature is more than about 120° C. or the tempering temperature is more than about 200° C., due to an increase of residual austenite during the quenching process, a fatigue property of the alloy steel and the like may be reduced, and when the tempering time is more than about 3 hours, due to a rapid reduction in hardness of the alloy steel, it may be difficult to improve a durability life and the like.

Hereinafter, in yet another aspect of the present inventive concept, a transmission for a vehicle manufactured using the carburized alloy steel having improved durability is provided.

The transmission for the vehicle manufactured using the carburized alloy steel having improved durability according to the present inventive concept may be appropriately manufactured by a person with skill in the art with reference to a publicly known technology. In more detail, in the case where the transmission for the vehicle is manufactured using the carburized alloy steel, high strengthening of the corresponding material is made feasible, and thus, through a thickness reduction, a weight reduction of about 20%, and the like, the degree of freedom of a vehicle design may be secured and a manufacturing cost may be reduced.

Therefore, durability of the vehicle is increased, and a weight reduction of the vehicle is made feasible, and thus fuel efficiency is increased and environmental pollution is prevented.

EXAMPLE

Hereinafter, the present inventive concept will be described in more detail through the Examples. These Examples are only for illustrating the present inventive concept, and it will be obvious to those skilled in the art that the scope of the present inventive concept is not interpreted to be limited by these Examples.

In order to compare physical properties of the carburized alloy steel having improved durability according to the present inventive concept, Comparative Examples and Examples having the components as described in the following Table 1, to which the conditions of the carburizing temperature and time, the quenching oil temperature, and the tempering temperature and time described in the following Table 2 were applied, were manufactured.

TABLE 1

| Classification | Unit | Comparative Example 1 | Comparative Example 2 | Comparative Example 3 | Example 1 | Example 2 |
|---|---|---|---|---|---|---|
| C | wt % | 0.19 | 0.20 | 0.22 | 0.33 | 0.18 |
| Si | wt % | 0.63 | 0.62 | 0.63 | 0.55 | 1.86 |
| Mn | wt % | 0.65 | 0.61 | 0.58 | 0.78 | 1.23 |
| Cr | wt % | 2.06 | 3.64 | 3.73 | 1.75 | 2.99 |
| Ni | wt % | — | — | — | 0.15 | 0.58 |
| Mo | wt % | 0.38 | — | 0.16 | 0.25 | 0.48 |
| Nb | wt % | 0.029 | 0.026 | 0.025 | 0.052 | 0.066 |
| V | wt % | — | — | — | 0.16 | 0.29 |
| Ti | wt % | — | 0.0018 | — | 0.18 | 0.04 |
| B | wt % | — | 0.013 | — | 0.000043 | 0.000026 |
| N | wt % | 0.0079 | 0.0067 | 0.0083 | 0.006 | 0.0053 |

In Table 1, the constitutional components and the contents of Comparative Examples 1 to 3 according to the existing alloy steel and the constitutional components and the contents of Examples 1 and 2 according to the present inventive concept were compared.

TABLE 2

| Classification | Comparative Example 1 | Comparative Example 2 | Comparative Example 3 | Example 1 | Example 2 |
|---|---|---|---|---|---|
| Carburizing temperature (° C.)/time (h) | 930/3.5 | 940/1.65 | 930/1.8 | 930/3.5 | 980/2.33 |
| Quenching oil temperature (° C.) | 110 | 100 | 110 | 80 | 120 |
| Tempering temperature (° C.)/time (h) | 180/2.3 | 170/2.3 | 190/2.5 | 150/3 | 200/1 |

Table 2 is a table where among the manufacturing conditions of Comparative Examples 1 to 3 and Examples 1 and 2 having the constitutional components and the contents of Table 1, the carburizing temperatures and times, the quenching oil temperatures, and the tempering temperatures and times are compared. Herein, all of Comparative Examples 1 to 3 and Examples 1 and 2 satisfied the carburizing temperature and time, the quenching oil temperature, and the tempering temperature and time according to the present inventive concept.

TABLE 3

| Classification | Comparative Example 1 | Comparative Example 2 | Comparative Example 3 | Example 1 | Example 2 |
|---|---|---|---|---|---|
| Surface hardness (HV) | 725 | 732 | 744 | 826 | 832 |
| Core hardness (HV) | 494 | 511 | 515 | 545 | 538 |
| Tensile strength (MPa) | 1066 | 1209 | 1216 | 1235 | 1243 |
| Yield strength (MPa) | 959 | 1075 | 1093 | 1096 | 1127 |
| Carburizing depth (mm) | 0.70 | 0.72 | 0.73 | 0.77 | 0.79 |
| Impact value (J) | 26.8 | 23.6 | 38.8 | 47.3 | 48.6 |
| Rotation bending strength (K) | 106 | 117 | 127 | 149 | 152 |
| Contact fatigue life (time, cycle) | 4,170,000 | 8,380,000 | 9,060,000 | 13,400,000 | 14,800,000 |
| Precipitate portion (%) | 0.04 | 0.05 | 0.04 | 0.08 | 0.08 |
| Martensite portion (%) | 41 | 39 | 42 | 87 | 88 |

Table 3 is a table where after Comparative Examples 1 to 3 and Examples 1 and 2 having the constitutional components and the contents of Table 1 are manufactured according to the condition of Table 2, surface hardnesses, core hardnesses, tensile strengths, yield strengths, carburizing depths, impact values, rotation bending strengths, and contact fatigue lives, precipitate portions, and martensite portions are compared.

Surface hardness and core hardness were measured according to the KS B 0811 measurement method by using the Micro Vickers Hardness tester, and in the case of rotation bending strength, the L10 life was measured according to the KS B ISO 1143 measurement method under the condition of the maximum flection moment of about 20 kgfm, the rotation number of about 200 to 3000 RPM, the maximum load of about 100 kg or less, and electric power of three phases, 220 V, and 7 kW by using the standard line diameter of about 4 mm through the rotation bending fatigue tester.

The L10 life is the rating fatigue life of the specimen, and means the total rotation number of the rotation bending fatigue tester until about 10% of the specimen is damaged. Further, in the case of contact fatigue, the rotation number of the roller for contact fatigue test until cracks were formed in the specimen was measured under the condition of surface pressure of about 332 kg/mm$^2$, the lubricant temperature of about 80° C., and the lubricant amount of about 1.2 l/min by using the contact fatigue experiment apparatus.

Examples 1 and 2 exhibited values of surface hardness and core hardness that were both higher than those of Comparative Examples 1 to 3, the values of tensile strength and yield strength were highest in Example 2, the carburizing depth of Examples 1 and 2 was larger than that of Comparative Examples 1 to 3, and the impact value, rotation bending strength, and the contact fatigue life of Examples 1 and 2 were superior to those of Comparative Examples 1 to 3. Further, it could be confirmed that both the precipitate and martensite portions were improved.

Therefore, it could be confirmed that in Examples 1 and 2 according to the present inventive concept, as compared to Comparative Examples 1 to 3, surface hardness was superior by about 10%, core hardness was superior by about 12%, tensile strength and yield strength were each superior by about 5%, the carburizing depth was superior by about 7%, the impact value was superior by about 52%, rotation bending strength was superior by about 24%, and the contact fatigue life was superior by about 72%.

As described above, the present inventive concept has been described in relation to specific embodiments of the present inventive concept, but the embodiments are only illustration and the present inventive concept is not limited thereto. Embodiments described may be changed or modified by those skilled in the art to which the present inventive concept pertains without departing from the scope of the present inventive concept, and various alterations and modifications are possible within the technical spirit of the present inventive concept and the equivalent scope of the claims which will be described below.

What is claimed is:

1. A carburized alloy steel comprising:

based on a total weight of the carburized alloy steel, 0.1 to 0.35 wt % carbon, 0.1 to 2.0 wt % silicon, 0.1 to 1.5 wt % manganese, 1.5 to 3.0 wt % chromium, 0.2 to 0.5 wt % molybdenum, greater than 0 to 0.07 wt % niobium, 0.1 to 0.6 wt % nickel, more than 0 to 0.3 wt % vanadium, more than 0 to 0.2 wt % titanium, more than 0 to 0.015 wt % nitrogen, 0.00002 to 0.00005 wt % boron, and a balance of iron.

2. A method of manufacturing a carburized alloy steel, the method comprising steps of:

carburizing an alloy steel comprising, based on a total weight of the carburized alloy steel, 0.1 to 0.35 wt % carbon, 0.1 to 2.0 wt % silicon, 0.1 to 1.5 wt % manganese, 1.5 to 3.0 wt % chromium, 0.2 to 0.5 wt % molybdenum, greater than 0 to 0.07 wt % niobium, 0.1 to 0.6 wt % nickel, more than 0 to 0.3 wt % vanadium, more than 0 to 0.2 wt % titanium, more than 0 to 0.015 wt % nitrogen, 0.00002 to 0.00005 wt % boron, and a balance of iron, at 880 to 940° C. for 1.5 to 2 hours;

oil-quenching the carburized alloy steel at 80 to 120° C.; and tempering the oil-quenched alloy steel at 170 to 200° C. for 1 to 3 hours.

3. A transmission for a vehicle manufactured using the carburized alloy steel of claim 1.

* * * * *